US007738003B2

(12) United States Patent
Jung

(10) Patent No.: US 7,738,003 B2
(45) Date of Patent: Jun. 15, 2010

(54) DISPLAY DEVICE FOR SHIFTING LOCATION OF PIXELS AND METHOD THEREOF

(75) Inventor: Jae-woong Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1130 days.

(21) Appl. No.: 11/353,043

(22) Filed: Feb. 14, 2006

(65) Prior Publication Data

US 2007/0019007 A1 Jan. 25, 2007

(30) Foreign Application Priority Data

Jul. 19, 2005 (KR) ..... 10-2005-0065497

(51) Int. Cl.
*G09G 5/02* (2006.01)

(52) U.S. Cl. ..... 345/698; 345/3.3

(58) Field of Classification Search ..... 345/690–699, 345/3.1–3.4, 204–215, 60–72, 76–111; 315/169.1–169.4
See application file for complete search history.

(56) References Cited

U.S. PATENT DOCUMENTS

| | | | | |
|---|---|---|---|---|
| 5,874,937 | A * | 2/1999 | Kesatoshi | 345/428 |
| 6,061,048 | A * | 5/2000 | Choi | 715/785 |
| 6,714,692 | B1 * | 3/2004 | Kim et al. | 382/299 |
| 7,432,931 | B2 * | 10/2008 | Someya et al. | 345/475 |
| 2004/0027313 | A1 * | 2/2004 | Pate et al. | 345/30 |
| 2004/0113922 | A1 * | 6/2004 | Choe et al. | 345/613 |
| 2004/0135768 | A1 * | 7/2004 | Gu | 345/156 |
| 2004/0150659 | A1 | 8/2004 | Nakano et al. | |
| 2005/0024391 | A1 * | 2/2005 | Damera-Venkata et al. | 345/698 |
| 2005/0140934 | A1 | 6/2005 | Seo et al. | |

FOREIGN PATENT DOCUMENTS

| | | | |
|---|---|---|---|
| EP | 1 503 360 | A2 | 2/2005 |
| KR | 10-2004-0037369 | * | 5/2004 |
| KR | 10-2004-0037369 | A | 5/2004 |
| WO | WO 2004-075152 | A1 | 9/2004 |

* cited by examiner

*Primary Examiner*—Chanh Nguyen
*Assistant Examiner*—Long Pham
(74) *Attorney, Agent, or Firm*—Roylance, Abrams, Berdo and Goodman, LLP

(57) ABSTRACT

A display device and method are provided for shifting the location of pixels. The display device has a display panel with a certain panel resolution, a signal input part for receiving an input signal with a certain input resolution, a resolution adjustment part for adjusting the panel resolution of the display panel to an output resolution matched with the input resolution, a signal process part for processing the input signal to be output through the display panel, a pixel shift distance calculation part for calculating a pixel shift distance on the display panel by using a proportional value between the panel resolution and the output resolution, and a control part for controlling the signal process part to shift a location of each pixel of the input signal displayed on the display panel the pixel shift distance in a certain direction at a certain time interval. Therefore, the pixels can be shifted the same distance, even though the resolution is varied.

15 Claims, 2 Drawing Sheets

DISPLAY DEVICE FOR SHIFTING LOCATION OF PIXELS AND METHOD THEREOF

CROSS-REFERENCE TO RELATED APPLICATIONS

This application claims the benefit under 35 U.S.C. §119 (a) of Korean Patent Application No. 10-2005-0065497, filed in the Korean Intellectual Property Office on Jul. 19, 2005, the entire disclosure of which is incorporated herein by reference.

BACKGROUND OF THE INVENTION

1. Field of the Invention

The present invention relates to a display device which displays input image signals on a screen, and a method thereof. More particularly, the present invention relates to a display device which shifts the location of pixels on a screen to prevent a burn-in, and a method thereof.

2. Description of the Related Art

If the same image pattern is displayed on a display device for a long time, a burn-in occurs which leaves an afterimage on a panel. To prevent the burn-in, recently-distributed display devices have a function for shifting a location of the pixels. The function for shifting the location of the pixels, which shifts the location of each pixel at a certain time interval, prevents the burn-in as the fixed image pattern is displayed.

To perform the function for shifting the location of the pixels, a user of the display device may set the shifting distance of the pixels. If the shifting distance of the pixels is set to be large, it can easily prevent the afterimage, but may cause eyestrain due to the intense movement of images on the screen. However, if the shifting distance of the pixels is set to be small, the afterimage may not be effectively prevented, but the image on the screen can be stable as viewed by the user. A user can typically set the shifting distance of the pixels as large as he/she wishes to use the function for shifting the pixels.

The above can be used with panels for a display device which each have a certain resolution. Generally, a panel with 852*480 resolution is considered to be a standard definition (SD) display device, and a panel with 1024*768 resolution is considered to be a high definition (HD) display device.

Various external input signals such as PC signals and DVD reproducing signals besides TV broadcasting signals, may be input to the display device. Accordingly, each input signal also has various input resolutions. Particularly, input signals having various resolutions of 640*480, 800*600, 1024*768, and 1280*768 may be input to the display device.

If the input signal does not have the identical input resolution as the panel resolution, one of the input resolution and the panel resolution is adjusted to display the input signal on the screen. That is, if the input resolution is higher than the panel resolution, the input resolution decreases to be adjusted to the panel resolution. However, if the input resolution is lower than the panel resolution, the panel resolution decreases to be adjusted to the input resolution. At this time, if the panel resolution decreases to be adjusted to the input resolution, the output resolution decreases. Therefore, the size of one pixel becomes larger.

At this time, the moving distance of an image corresponding to the shifting distance of pixels set by the user may be varied. In particular, if the signal of 800*600 resolution is displayed on the display device with a panel of 1024*768 resolution, the panel resolution itself is adjusted to the resolution of 800*600. The size of one dot of 1024*768 resolution is different from the size of one dot of 800*600 resolution. If a user sets the shifting distance of pixels to 2 dots and the pixel moves by 2 dots, the actual moving distance of image becomes larger on the screen. Accordingly, the movement of the image on the screen may become intense enough to cause fatigue in the eyes of the user.

Accordingly, a need exists for a more effective and efficient system and method for shifting the location of pixels on a screen to prevent a burn-in.

SUMMARY OF THE INVENTION

Accordingly, aspects of embodiments of the present invention are to solve at least the above and other problems, and to provide at least the advantages described below. Therefore, an object of embodiments of the present invention is to provide a display device which moves pixels a certain distance corresponding to the required shifting distance of pixels set by a user, even though various image signals are input with varied input resolutions, and a method thereof.

To achieve the above-described and other objects, a display device is provided comprising a display panel with a certain panel resolution, a signal input part for receiving an input signal with a certain input resolution, a resolution adjustment part for adjusting the panel resolution of the display panel to an output resolution matched with the input resolution, a signal process part for processing the input signal to output through the display panel, a pixel shift distance calculation part for calculating a pixel shift distance on the display panel by using a proportional value between the panel resolution and the output resolution, and a control part for controlling the signal process part to shift a location of each pixel of the input signal displayed on the display panel the pixel shift distance in a certain direction at a certain time interval.

The device may further comprise an input part for receiving a certain pixel shift demand distance, and a storage part for storing the pixel shift demand distance input by the input part.

The pixel shift distance may be calculated by multiplying a proportional value between the output resolution and the panel resolution by the pixel shift demand distance.

The pixel shift distance calculation part may comprise a database part having a proportional value information corresponding to each resolution, and a calculation part for reading the proportional value corresponding to the output resolution from the data base, multiplying the proportional value by the pixel shift demand distance, and supplying the signal process part with the multiplied value as the pixel shift distance.

The pixel shift distance calculation part comprises a first calculation part for calculating the proportional value between the output resolution and the panel resolution, and a second calculation part for multiplying the proportional value calculated from the first calculation part by the pixel shift demand distance and supplying the signal process part with the multiplied value as the pixel shift distance.

To achieve the above-described and other objects, a display method is provided using a display panel with a certain panel resolution, the display method comprising, receiving an input signal with a certain input resolution, adjusting the panel resolution of the display panel to an output resolution corresponding to the input resolution, processing the input signal to be output through the display panel, calculating a pixel shift distance on the display panel by using a proportional value between the panel resolution and the output resolution, and shifting a location of each pixel of the input signal displayed on the display panel the pixel shift distance in a certain direction at a certain time interval.

The method may further comprise receiving and storing a certain pixel shift demand distance.

The pixel shift distance may be calculated by multiplying a proportional value between the output resolution and the panel resolution by the pixel shift demand distance.

The step of calculating the pixel shift distance may comprise reading the proportional value corresponding to the input resolution from a data base having a proportional value information corresponding to each resolution, and multiplying the read proportional value by the pixel shift demand distance and obtaining the multiplied value as the pixel shift distance.

The step of calculating the pixel shift distance may comprise, calculating the proportional value between the output resolution and the panel resolution, and multiplying the calculated proportional value by the pixel shift demand distance and obtaining the multiplied value as the pixel shift distance.

BRIEF DESCRIPTION OF THE DRAWINGS

The above and other aspects and features of embodiments of the present invention will become more apparent by describing certain embodiments of the present invention with reference to the accompanying drawings, in which.

Throughout the drawings, like reference numerals will be understood to refer to like parts, components and structures.

DETAILED DESCRIPTION OF THE EXEMPLARY EMBODIMENTS

Figure 1:
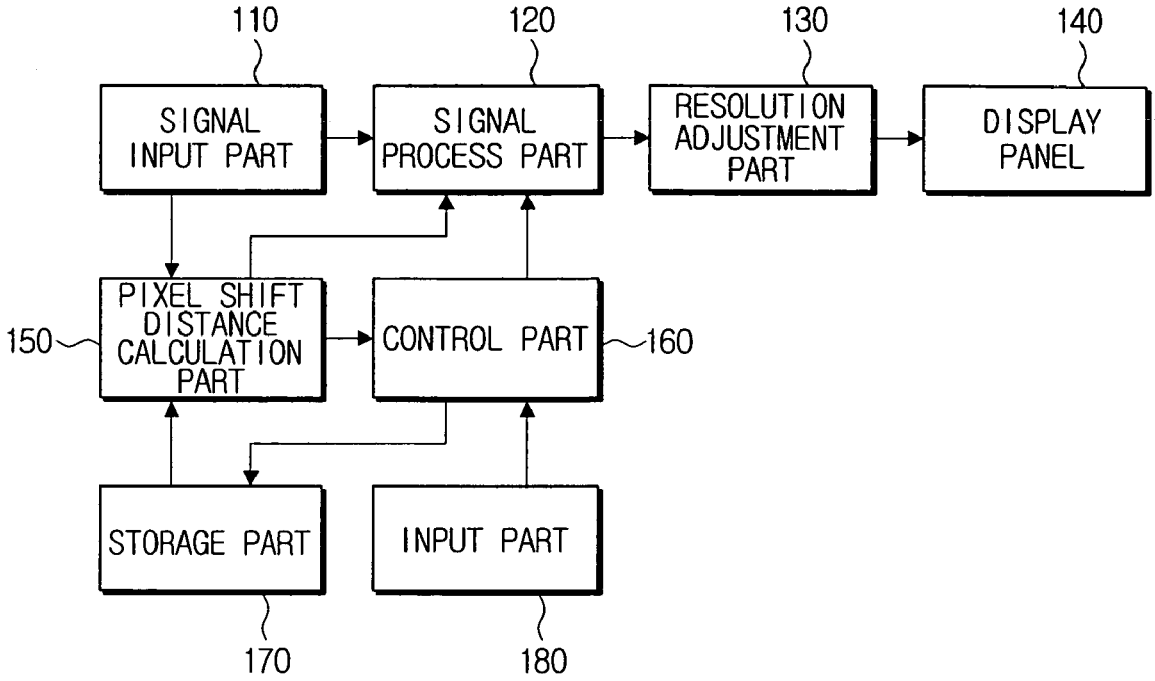
FIG. 1 is a block diagram of an exemplary display device according to an embodiment of the present invention.

Exemplary embodiments of the present invention will now be described in detail with reference to the annexed drawings. In the drawings, the same elements are denoted by the same reference numerals throughout the drawings. In the following description, detailed descriptions of known functions and configurations incorporated herein have been omitted for conciseness and clarity.

FIG. 1 is a block diagram of an exemplary display device according to an embodiment of the present invention. The display device of FIG. 1 comprises a signal input part 110, a signal process part 120, a resolution adjustment part 130, a display panel 140, a pixel shift distance calculation part 150, a control part 160, a storage part 170, and an input part 180. The display device of FIG. 1 may be a television or a monitor employing a plasma display panel (PDP), but is not limited thereto.

The signal input part 110 receives image signals with a certain input resolution. The image signals may be broadcast signals received from a TV broadcasting station or satellite, and exterior input signals received from a DVD player, VCR player and PC, but are not limited thereto.

The signal process part 120 processes the image signals received from the signal input part 110. Particularly, the signal process part 120 performs decoding, scaling, D/A converting and multiplexing. Since the signal processing of the signal process part 120 is well known to those skilled in the art, a detailed description thereof will be omitted for the sake of brevity.

The display panel 140 has a certain panel resolution and displays thereon the image signals signal-processed by the signal process part 120. A plasma display panel (PDP) may be applied as the display panel 140, but is not limited thereto. The PDP is a display element comprised using a gas discharge effect that fills a gas into an airtight space surrounded by a front glass, a rear glass and partitions therebetween and which then supplies a power to the space.

The resolution adjustment part 130 adjusts the panel resolution of the display panel 140 to an output resolution which is matched with the input resolution of image signals. That is, the entire group of pixels of the display panel 140 are divided according to the input resolution and the same power is supplied to the divided pixels, such that the panel resolution can be adjusted to match the input resolution. As a result, the output resolution becomes the same as the input resolution.

The pixel shift distance calculation part 150 calculates the number of dots of each pixel that will actually move on the panel. Particularly, the pixel shift distance calculation part 150 can calculate the pixel shift distance by the following equation (1):

$$\alpha = \frac{\text{output resolution}}{\text{panel resolution}} \times \beta \tag{1}$$

in which, $\alpha$ denotes a pixel shift distance, and $\beta$ denotes a pixel shift demand distance. According to equation 1, the pixel shift distance calculation part 150 multiplies the proportional value between the output resolution, i.e., the input resolution, and the panel resolution, by the pixel shift demand distance, to calculate the pixel shift distance.

The control part 160 supplies the signal process part 120 with the calculated pixel shift distance so that the signal process part 120 moves each pixel of the input signal the pixel shift distance at a certain time interval. At this time, the time interval and the direction of pixel shift may be preset. That is, the pixels may be shifted sequentially in right, down, left, and up directions.

The pixel shift demand distance may be set by a display device manufacturer, or arbitrarily adjusted by a display device user. The display device user may input the pixel shift demand distance by using the input part 180, but is not limited thereto.

That is, as button keys of a remote controller or a display device body are operated, the input part 180 provides the control part 160 with certain key values. The control part 160 senses the pixel shift demand distance according to the key values. The pixel shift demand distance input by a user is then stored in the storage part 170. The pixel shift distance calculation part 150 reads the pixel shift demand distance stored in the storage part 170 and substitutes the pixel shift demand distance for the $\beta$ value of equation 1 to calculate the pixel shift distance. The proportional value for calculating the pixel shift distance may be read from the pre-stored database, or the pixel shift distance calculation part 150 itself may calculate the proportional value by dividing.

Figure 2:
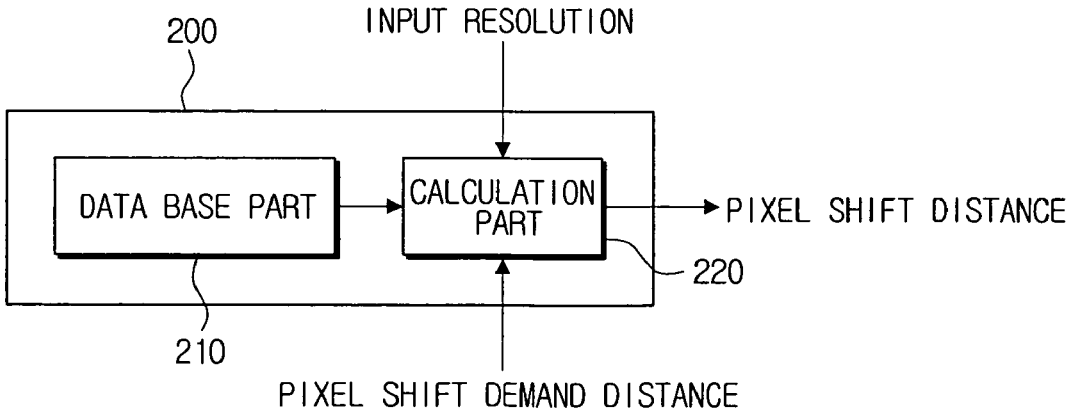
FIG. 2 is a block diagram of an example of a pixel shift distance calculation part for the display device of FIG. 1.

FIG. 2 is a block diagram of an exemplary embodiment of the pixel shift distance calculation part 150 using the database. For the convenience of explanation, the exemplary pixel shift distance calculation part of FIG. 2 uses the reference numeral 200. The pixel shift distance calculation part 200 of FIG. 2 comprises a database part 210 and a calculation part 220. The proportional value between the output resolution and the panel resolution is recorded on the database part 210. Particularly, the database part 210 applying to the display device with a panel resolution of 1024*768, for example, may be shown as Table 1 below, by way of example.

TABLE 1

| Input resolution | Pixel shift distance in a widthwise direction | Pixel shift distance in a lengthwise direction |
|---|---|---|
| 640 * 480 @60 Hz | 0.625 | 0.625 |
| 800 * 600 @60 Hz | 0.78 | 0.78 |
| 1024 * 768 @60 Hz | 1 | 1 |

In Table 1, the pixel shift distance in a widthwise direction refers to a shift distance of pixels as pixels are shifted in a widthwise direction on the screen, and the pixel shift distance in a lengthwise direction refers to a shift distance of pixels as pixels are shifted in a lengthwise direction.

The calculation part 220 reads out the proportional value corresponding to the input resolution from the database part 210 and multiplies the read proportional value by the pixel shift demand distance to calculate the pixel shift distance.

Figure 3:
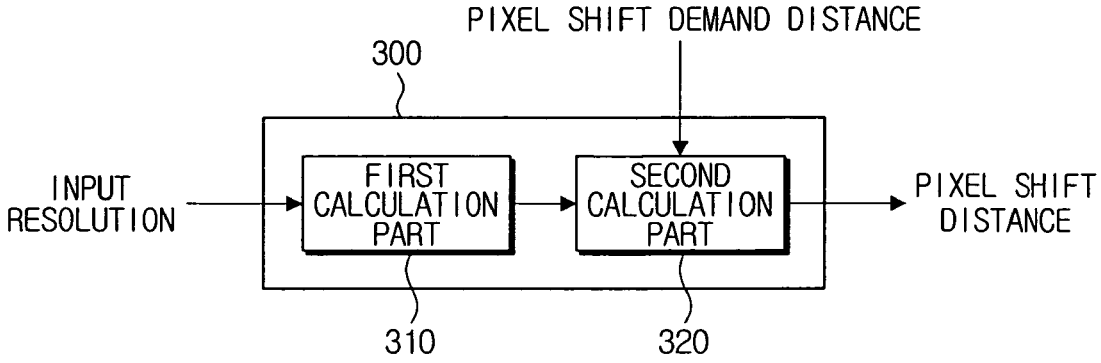
FIG. 3 is a block diagram of another example of a pixel shift distance calculation part for the display device of FIG. 1.

FIG. 3 is a block diagram of an exemplary embodiment of the pixel shift distance calculation part 150 that calculates the proportional value by itself. For the convenience of explanation, the pixel shift distance calculation part of FIG. 3 uses the reference numeral 300. The pixel shift distance calculation part 300 of FIG. 3 comprises a first calculation part 310 and a second calculation part 320. The first calculation part 310 divides the input resolution by the panel resolution to calculate the proportional value. The second calculation part 320 multiplies the proportional value calculated from the first calculation part 310 by the pixel shift demand distance to calculate the pixel shift distance.

Figure 4:
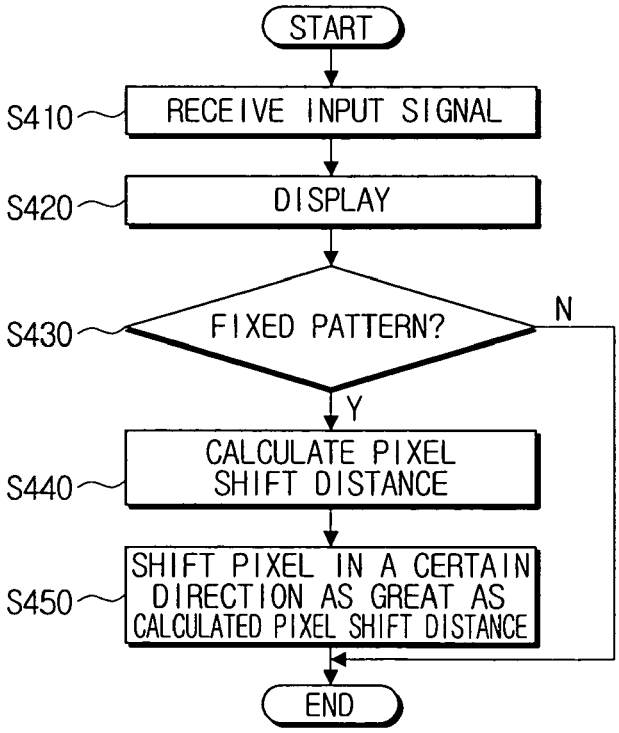
FIG. 4 is a flowchart of an exemplary method for displaying pixels according to an embodiment of the present invention.

FIG. 4 is a flowchart of an exemplary display method according to an embodiment of the present invention. Referring to FIG. 4, if input signals are received at step (S410), the signals are processed to display on the screen at step (S420). At this time, the panel resolution is adjusted to an output resolution that is the same as the input resolution.

If the image displayed on the screen is a fixed pattern at step (S430), the pixel shift distance is calculated by using the proportional value between the input resolution i.e., the output resolution, and the panel resolution at step (S440). Particularly, the pixel shift distance can be calculated by using the aforementioned equation 1.

Then, each pixel of the input signal is shifted the pixel shift distance at step (S450). Therefore, the burn-in which is caused by displaying an image of the fixed pattern for a long time, can be prevented.

As described above, although image signals of various input resolutions are input, the pixel can be shifted the pixel shift distance corresponding to the pixel shift demand distance set by a user. Accordingly, a user's demand can be accurately satisfied. Particularly, the moving distance of an image can be prevented from becoming greater even though the output resolution decreases so that the image quality can be enhanced.

While the present invention has been shown and described with reference to certain exemplary embodiments thereof, it will be understood by those skilled in the art that various changes in form and detail may be made therein without departing from the spirit and scope of the present invention as defined by the appended claims.

What is claimed is:

1. A display device, comprising:

a display panel with a certain panel resolution;

a signal input part for receiving an input signal with a certain input resolution;

a resolution adjustment part for matching an output resolution of the display panel with the input resolution;

a signal process part for processing the input signal to be output through the display panel;

a pixel shift distance calculation part for calculating a pixel shift distance on the display panel by using a pixel shift demand distance multiplied by a ratio value between the panel resolution and the output resolution; and a control part for controlling the signal process part to shift a location of each pixel of the input signal displayed on the display panel the pixel shift distance in a certain direction at a certain time interval.

2. The device as claimed in claim 1, further comprising:

an input part for receiving a certain pixel shift demand distance; and a storage part for storing the pixel shift demand distance input by the input part.

3. The device as claimed in claim 2, wherein the pixel shift distance is calculated by the following equation:

$$\alpha = \frac{\text{output resolution}}{\text{panel resolution}} \times \beta$$

in which, α comprises a pixel shift distance, and β comprises the pixel shift demand distance.

4. The device as claimed in claim 3, wherein the pixel shift distance calculation part comprises:

a database part having a ratio value information corresponding to each resolution; and a calculation part for reading the ratio value corresponding to the output resolution from the data base, multiplying the ratio value by the pixel shift demand distance, and supplying the signal process part with the multiplied value as the pixel shift distance.

5. The device as claimed in claim 3, wherein the pixel shift distance calculation part comprises:

a first calculation part for calculating the ratio value between the output resolution and the panel resolution; and a second calculation part for multiplying the ratio value calculated from the first calculation part by the pixel shift demand distance, and supplying the signal process part with the multiplied value as the pixel shift distance.

6. A display method using a display panel with a certain panel resolution, the display method comprising:

receiving an input signal with a certain input resolution;

matching an output resolution of the display panel with the input resolution;

processing the input signal to be output through the display panel;

calculating a pixel shift distance on the display panel by using a pixel shift demand distance multiplied by a ratio value between the panel resolution and the output resolution; and shifting a location of each pixel of the input signal displayed on the display panel the pixel shift distance in a certain direction at a certain time interval.

7. The method as claimed in claim 6, further comprising:

receiving and storing a certain pixel shift demand distance.

8. The method as claimed in claim 7, wherein the pixel shift distance is calculated by the following equation:

$$\alpha = \frac{\text{output resolution}}{\text{panel resolution}} \times \beta$$

in which, α comprises a pixel shift distance, and β comprises the pixel shift demand distance.

9. The method as claimed in claim 8, wherein the step of calculating the pixel shift distance comprises:

reading the ratio value corresponding to the input resolution from a data base having a ratio value information corresponding to each resolution; and multiplying the read ratio value by the pixel shift demand distance and obtaining the multiplied value as the pixel shift distance.

10. The method as claimed in claim 8, wherein the step of calculating the pixel shift distance comprises:

calculating the ratio value between the output resolution and the panel resolution; and multiplying the calculated ratio value by the pixel shift demand distance and obtaining the multiplied value as the pixel shift distance.

11. A method for controlling a display panel with a certain panel resolution, comprising:

receiving an input signal with a certain input resolution;

matching an output resolution of the display panel with the input resolution;

calculating a pixel shift distance on the display panel by using a pixel shift demand distance multiplied by a ratio value between the panel resolution and the output resolution; and shifting a location of each pixel of the input signal displayed on the display panel the pixel shift distance in a certain direction at a certain time interval.

12. The method as claimed in claim 11, further comprising:

receiving and storing a certain pixel shift demand distance.

13. The method as claimed in claim 12, wherein the pixel shift distance is calculated by the following equation:

$$\alpha = \frac{\text{output resolution}}{\text{panel resolution}} \times \beta$$

in which, α comprises a pixel shift distance, and β comprises the pixel shift demand distance.

14. The method as claimed in claim 13, wherein calculating the pixel shift distance comprises:

reading a ratio value corresponding to the input resolution from a data base having a ratio value information corresponding to each resolution; and multiplying the read ratio value by the pixel shift demand distance and obtaining the multiplied value as the pixel shift distance.

15. The method as claimed in claim 13, wherein calculating the pixel shift distance comprises:

calculating a ratio value between the output resolution and the panel resolution; and multiplying the calculated ratio value by the pixel shift demand distance and obtaining the multiplied value as the pixel shift distance.

* * * * *